US012735165B2

(12) United States Patent
Sirrola

(10) Patent No.: US 12,735,165 B2
(45) Date of Patent: Sep. 15, 2026

(54) OIL FILTRATION AND LUBRICATION SYSTEM FOR SEALING SYSTEM OF AZIMUTH THRUSTER

(71) Applicant: Steerprop Oy, Rauma (FI)

(72) Inventor: Jarkko Sirrola, Rauma (FI)

(73) Assignee: Steerprop Oy, Rauma (FI)

( * ) Notice: Subject to any disclaimer, the term of this patent is extended or adjusted under 35 U.S.C. 154(b) by 565 days.

(21) Appl. No.: 18/348,162

(22) Filed: Jul. 6, 2023

(65) Prior Publication Data

US 2025/0002131 A1 Jan. 2, 2025

(30) Foreign Application Priority Data

Jun. 27, 2023 (EP) ..... 23181785

(51) Int. Cl.
*B63H 21/38* (2006.01)

(52) U.S. Cl.
CPC ..... *B63H 21/386* (2013.01)

(58) Field of Classification Search
CPC .... B63H 21/386; B01D 29/115; B01D 29/58; F01M 2001/1092; F01M 1/10; F16N 2200/04; F16N 2200/20; F16N 2210/06; F16N 39/06
See application file for complete search history.

(56) References Cited

U.S. PATENT DOCUMENTS 4,168,070 A * 9/1979 Tsuchihashi ..... B63H 23/321 277/927
7,641,526 B1 * 1/2010 Bekker ..... B63H 25/42 440/54
2014/0034580 A1 * 2/2014 Chen ..... F16N 39/06 210/708
2021/0231634 A1 * 7/2021 Gillette ..... G01N 33/2847
2022/0152527 A1 * 5/2022 Wieczorek ..... B01D 17/02

FOREIGN PATENT DOCUMENTS

CN 111608997 A * 9/2020 ..... B63H 5/125
WO WO-2017122358 A1 * 7/2017 ..... F16J 15/46

* cited by examiner

*Primary Examiner* — Andrew Polay
(74) *Attorney, Agent, or Firm* — Ziegler IP Law Group, LLC.

(57) ABSTRACT

Disclosed is an oil filtration and lubrication system for a sealing system of an azimuth thruster, oil filtration and lubrication system includes oil filter comprising layers of filter material, layers being arranged within oil filtration chamber, have predefined distance therebetween; and oil circulation arrangement, when system is in use, oil circulation arrangement enables passage of unfiltered oil between layers, at flow rate which is less than predefined flow rate, oil filter removes impurities from unfiltered oil, and then filtered oil is passed from oil filter to sealing system of azimuth thruster, by oil circulation arrangement, filtered oil lubricates azimuthing seal, propeller shaft seal, of azimuth thruster, and wherein oil filter is configured to remove impurities from oil, which impurities have a size down to 0.1 micrometre.

12 Claims, 7 Drawing Sheets

OIL FILTRATION AND LUBRICATION SYSTEM FOR SEALING SYSTEM OF AZIMUTH THRUSTER

TECHNICAL FIELD

The present disclosure relates to oil filtration and lubrication systems for sealing systems of azimuth thrusters. The present disclosure also relates to systems incorporating such oil filtration and lubrication systems. The present disclosure further relates to methods implementing such oil filtration and lubrication systems.

BACKGROUND

Azimuth thrusters are widely employed in marine applications to enhance vessel manoeuvrability and operational efficiency. These thrusters consist of a propeller mounted on a rotatable pod, enabling 360-degree directional control. A sealing system, such as an azimuthing seal, is integrated into the thruster to prevent oil leakage and ensure the efficient operation of the propulsion system.

In conventional azimuth thruster, lubrication is achieved by using lubrication oil within the sealing system. However, over time, impurities and contaminants can accumulate in the oil, compromising its lubricating properties and potentially causing damage to the sealing components. Therefore, effective oil filtration and lubrication systems are essential to maintain optimal performance and extend the service life of the sealing system.

However, the existing oil filtration and lubrication systems often face challenges in effectively removing impurities from the oil and ensuring a consistent supply of clean and properly lubricated oil to the sealing system. Moreover, they are expensive to maintain. The filter can become clogged with contaminants and need to be replaced regularly. Inadequate filtration can lead to the deposition of contaminants on sealing surfaces, reducing their effectiveness and increasing the risk of oil leakage. Insufficient lubrication may result in increased friction, wear, and potential damage to the sealing components.

Therefore, in light of the foregoing discussion, there exists a need to overcome the aforementioned drawbacks.

SUMMARY

The aim of the present disclosure is to provide an oil filtration and lubrication system, a system and a method implementing such an oil filtration and lubrication system to remove impurities from oil, such impurities down to 0.1 micrometre in size. The aim of the present disclosure is achieved by an oil filtration and lubrication system for a sealing system of an azimuth thruster, a system and a method implementing such an oil filtration and lubrication system, as defined in the appended independent claims to which reference is made to. Advantageous features are set out in the appended dependent claims.

Throughout the description and claims of this specification, the words "comprise", "include", "have", and "contain" and variations of these words, for example "comprising" and "comprises", mean "including but not limited to", and do not exclude other components, items, integers or steps not explicitly disclosed also to be present. Moreover, the singular encompasses the plural unless the context otherwise requires. In particular, where the indefinite article is used, the specification is to be understood as contemplating plurality as well as singularity, unless the context requires otherwise.

DETAILED DESCRIPTION OF EMBODIMENTS

Figure 1:
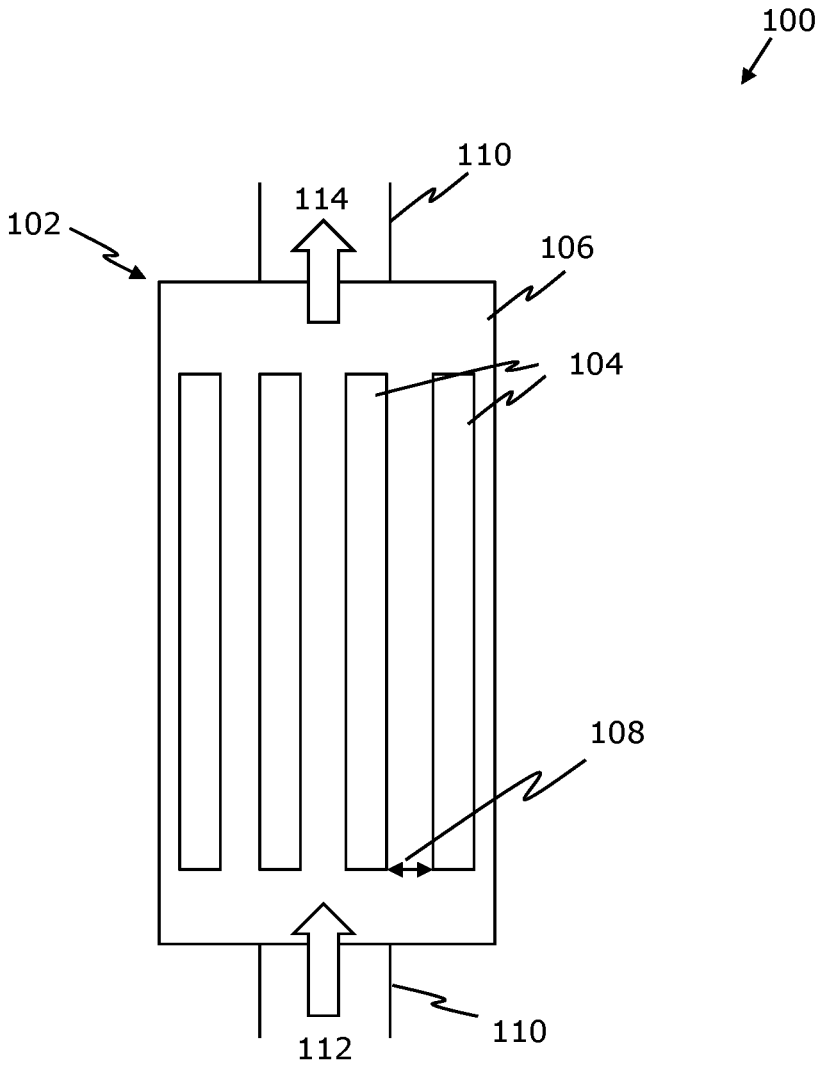
FIG. 1 is a schematic view of an oil filtration and lubrication system for a sealing system of an azimuth thruster, in accordance with an embodiment of the present disclosure.

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In a first aspect, the present disclosure provides an oil filtration and lubrication system for a sealing system of an azimuth thruster, the oil filtration and lubrication system comprising:

- an oil filter comprising a plurality of layers of a filter material, the plurality of layers being arranged within an oil filtration chamber such that adjacent layers amongst the plurality of layers have a predefined distance therebetween; and
- an oil circulation arrangement,
- wherein when the oil filtration and lubrication system is in use, the oil circulation arrangement enables passage of unfiltered oil between the layers of the oil filter, at a flow rate which is less than a predefined flow rate, the oil filter removes impurities from the unfiltered oil, and then filtered oil is passed from the oil filter to the sealing system of the azimuth thruster, by the oil circulation arrangement, and wherein the filtered oil lubricates at least one of: an azimuthing seal, a propeller shaft seal, of the azimuth thruster, and wherein the oil filter is configured to remove impurities from the oil, which impurities have a size of down to 0.1 micrometre. The impurities are (or can be) smaller than the lubrication oil film thickness under the seal.

According to the first aspect of the present disclosure, there is provided the aforementioned system for a sealing system of an azimuth thruster. The oil filtration and lubrication system ensures the removal of impurities and contaminants, including those as small as 0.1 micrometres from the oil. The filter element is positioned within the system to capture impurities before reaching the sealing system, thereby preventing potential damage or leakage. The system forms a closed-loop configuration that is fluidically coupled to the oil tank, oil filter, and sealing system (such as the azimuthing seal and propeller shaft seal). The closed-loop arrangement facilitates controlled oil flow, efficient filtration, and targeted lubrication, resulting in improved sealing system performance. Additionally, the oil circulation arrangement within the system ensures the flow of both unfiltered and filtered oil. The flow rate is controlled based on the rotational speed of the sealing system. A processor, coupled with sensors, monitors the rotational speed and adjusts the flow rate accordingly. This synchronization ensures that the sealing system receives the appropriate amount of clean, filtered oil for effective lubrication and sealing performance.

In a second aspect, the present disclosure provides a system comprising an azimuth thruster and an oil filtration and lubrication system of the first aspect, for the azimuth thruster.

According to the second aspect of the present disclosure, there is provided with the aforementioned system includes the azimuth thruster and the oil filtration and lubrication system. The oil filtration and lubrication system ensures that clean oil flows into the azimuth thruster that is free from contaminants which minimize the risk of component damage and oil leakage. The arrangement of the azimuth thruster and an oil filtration and lubrication system is configured to provide adequate lubrication and reduce friction, wear, and potential heat build-up. And all of this because the capability to remove the very small particles, down to 0.1 micrometre.

This enhances the performance of the system and also contributes to energy efficiency to extend the life of the azimuth thruster.

In a third aspect, the present disclosure provides a method comprising:

arranging an oil filtration and lubrication system of the first aspect in fluidic connection with an azimuth thruster; and using the oil filtration and lubrication system for removing impurities from unfiltered oil, and delivering filtered oil to the azimuth thruster.

According to the third aspect of the present disclosure, there is provided the aforementioned method. The method is configured to remove impurities from the oil, such as dirt, debris, and water. These impurities can cause wear and tear on the azimuth thruster, and can also lead to premature failure. By removing these impurities, the oil filtration and lubrication system can help to improve the reliability of the azimuth thruster. The oil filtration and lubrication system can also help to improve the performance of the azimuth thruster by reducing friction and improving safety by reducing the risk of fire or explosion.

Throughout the present disclosure, the term "azimuth thruster" as used herein refers to a type of marine propulsion system that uses a propeller to generate thrust in any direction. The propeller is mounted in a pod that can rotate 360 degrees, allowing the azimuth thruster to be used for both propulsion and steering. Typically, the pod is mounted on a gimbal that allows the thruster to be tilted in any direction. Optionally, the azimuth thruster also includes a control system that can be used to rotate the pod and tilt the gimbal. Herein, the azimuth thruster comprises the oil filtration and the lubrication system for the sealing system.

The term "sealing system" refers to a system that provides a barrier to prevent leakage or ingress of fluids, gases, or contaminants within the azimuth thruster. Typically, the sealing element present within the sealing system is configured to prevent the said ingress. The sealing material may include but is not limited to O-rings, gasket, lip seal, mechanical seal, gland packing, and so forth. Notably, the sealing material must possess properties such as flexibility, durability, chemical resistance, and thermal stability to withstand operating conditions. The sealing material is fabricated from rubber, silicone, metal, fibre or composite materials. The sealing element is designed to fit precisely, creating a tight and reliable seal against the passage of fluids or contaminants.

The term "oil filtration and lubrication system" refers to a system that removes contaminants from the oil and lubricates the moving parts. The oil filtration and lubrication system helps to keep the oil clean and free of debris. In particular, the oil filtration and lubrication system helps in lubricating the moving parts of the azimuth thruster to prevent wear and tear thereof and thereby extends the life of the azimuth thruster. Moreover, the oil filtration and lubrication system helps to reduce friction between moving parts of the azimuth thruster by applying a layer of lubricant between the parts, which helps to keep them from rubbing directly against each other. The oil filtration system works by circulating the oil through the azimuth thruster.

Typically, the oil forms a thin film between the moving parts, which helps to keep them from rubbing directly against each other. Thus, reducing wear and tear and extending the lifespan of the azimuth thruster. The oil is typically made from a base oil and a variety of additives are added to improve the performance of the oil and provide benefits, such as corrosion protection, wear resistance, and foaming control. In an embodiment, the oil used is a lubricating oil that is utilised in the oil filtration and lubrication system to lubricate the azimuth thruster to reduce friction, heat, and wear between the moving parts.

Moreover, the debris and contaminants from the azimuth thrust are mixed with the oil during the lubrication, therefore the oil filter is used in the oil filtration and lubrication system to filter the debris and contaminants from the oil. The oil filter is a component that is designed to remove impurities and contaminants from the oil before it circulates through the moving parts of the azimuth thruster. The oil filter is arranged to protect the engine by ensuring that clean oil is supplied to lubricate and also cool the moving parts. The oil filter is configured to remove particles such as dirt, metal shavings, and sludge, the oil filter helps to prevent premature wear, reduce friction, and maintain optimal performance.

The oil filter comprises the plurality of layers of the filter material. The plurality of layers of the filter material is stacked on top of each other to form the oil filter. The plurality of layers of the filter material increases the surface area available for capturing and trapping contaminants. Notably, each layer provides a surface for impurities to be captured, allowing for an improved capacity and lifespan of the oil filter before it needs to be replaced or cleaned. Moreover, the plurality of layers enables the filter material to have varying levels of filtration. Optionally, the plurality of layers has different pore sizes or structures, which allows for the removal of impurities of different sizes and types. In this regard, the oil filter includes a plurality of primary layers and a plurality of secondary layers stacked upon the plurality of primary layers. The plurality of primary layers can capture smaller impurities, while the plurality of secondary layers can capture larger impurities.

It will be appreciated that the stacking of the plurality of layers allows the progressive filtration of the oil as it passes through the filter material. The oil filter has the plurality of layers of the filter material arranged adjacent to each other have a predefined distance. The oil filter comprises a central core, which provides stability and support to the adjacently arranged plurality of layers. The central core is surrounded by the plurality of layers. A technical effect of the plurality of layers of the filter material enables the oil to pass through each layer, allowing varying filtration capabilities. The plurality of layers maximizes the surface area available for filtration, providing efficient removal of impurities and ensuring that clean oil is supplied to the oil filtration and lubrication system. Additionally, the plurality of layers helps with the uniform distribution and controlled flow of the oil being filtered. The plurality of layers is designed to promote even distribution of the oil ensuring that the oil passes through each layer before exiting the filter. This promotes more thorough filtration and prevents bypassing of unfiltered oil. Beneficially, the plurality of layers of filter material is typically more effective in filtering contaminants than oil filters with a single layer of filter material. This is because the multiple layers of filter material provide a larger surface area for contaminants to be trapped. In an embodiment, the filter material is arranged in a pleated or folded manner, which increases the surface area available for filtration. The said configuration allows for a larger contact area between the oil and the filter material, enhancing the ability to capture impurities.

The oil filter is configured to remove impurities from the oil, which impurities have a size down to 0.1 micrometre. The oil filter is configured in a way that it effectively captures and retains impurities with a size down to 0.1 micrometre. The impurities, if not removed, can cause abrasive wear, increase friction, clog oil passages, and impair the overall functioning of the azimuth thruster. The oil filter traps and removes impurities of the size limitation of 0.1 micrometre ensuring that even the smallest particles are effectively captured. The filter material is composed of passages or channels that allow oil to flow while trapping impurities. The passages are designed to have dimensions smaller than the targeted impurity size, ensuring that impurities are unable to pass through and are effectively captured.

Optionally, a length of a given layer amongst the plurality of layers of the filter material, along a direction of oil flow through the oil filtration chamber, lies in a range of 10-100 cm. Optionally, the length of a given layer amongst the plurality of layers of the filter material lies in the range of 10, 15, 30, 60, or 90 up to 15, 30, 60, 90 or 100. In this regard, the length of the given layer amongst the plurality of layers of the filter material may lie in a range of 10-100 cm along the direction of oil flow. Notably, the length of the plurality of layers ensures that the filter material is able to effectively filter the oil. If the length of the filter material is too short, it will not be able to remove all of the impurities from the oil. If the length of the filter material is too long, it will create too much resistance to the flow of oil, which can damage the azimuth thruster. For example, the length of each layer of filter material is in the range of 30 cm. If the length of one of the layers is less than 30 cm, it will not be able to remove all of the impurities from the oil and if the length of one of the layers is greater than 30 cm, it will create too much resistance to the flow of oil. A technical effect of the predetermined length of the given layer amongst the plurality of layers of the filter material is that it helps in ensuring that clean oil is provided to the azimuth thruster to prevent breakdown thereof.

Optionally, the filter material is at least one of: cellulose, fibreglass, paper, textile, a composite fibre or a combination of the aforementioned. In this regard, the filter material is fabricated from a porous material that allows oil to flow through it while trapping impurities. Optionally, the cellulose is utilised as the filter material and has a fibrous structure that provides a large surface area for trapping impurities. The fibreglass is a synthetic material composed of fine glass fibres and has high strength and temperature resistance as compared to the cellulose. Optionally, the paper is utilised to fabricate filter material due to its affordability and availability. In an embodiment, the textile-based filter material is used. The textile can include woven or non-woven fabrics. The textile offers better permeability and may have various pore sizes. More optionally, the composite fibre is used to create a filter material. The composite fibre can be engineered to provide strength, filtration efficiency, and durability. A technical effect of selecting the filter material depending on the capabilities is that it helps in performing the filtration of oil and lubrication of the moving part of the azimuth thruster effectively and also enables capturing the impurities.

The plurality of layers has the predefined distance therebetween. The predefined distance is a distance between the two layers of the filter material arranged adjacent to each other in the oil filter. Optionally, the predefined distance lies in a range of 10-50 micrometers. The predefined distance refers to the distance that has already been set. Optionally, the predefined distance lies in a range of 10, 15, 30, 60, or 45 up to 15, 30, 60, 45 or 50 micrometres. A technical effect of the predefined distance is that it enables the desired outcomes that help in achieving improved performance, efficiency and reliability.

The plurality of layers is arranged within the oil filtration chamber. The term "oil filtration chamber" is a compartment or space within the oil filtration and lubrication system that contains the oil filter and allows the oil to flow therethrough for filtration. The filtration chamber is designed to provide a space where the oil comes into contact with the oil filter, allowing the oil filter to capture and remove impurities from the oil. The oil filtration chamber is fabricated from materials such as metals like steel or aluminium, plastics or composite materials. These materials should be resistant to corrosion, heat, and pressure. Optionally, the oil flows into the oil filtration chamber through designated ports or channels. When the oil passes through the oil filter having the plurality of layers of the filter material, it traps and retains impurities and contaminants suspended in the oil. In an embodiment, the oil filtration chamber includes drain plugs or valves that allow for easy disposal of collected impurities during maintenance or oil filter replacement.

The term "oil circulation arrangement" is an arrangement that is configured to facilitate the flow of oil throughout the azimuth thruster, for ensuring lubrication and cooling. The oil circulation arrangement is arranged to maintain the optimal performance and longevity of the azimuth thruster. In an embodiment, the oil circulation arrangement includes an oil pump. The oil pump is responsible for drawing oil from a reservoir (such as an oil tank as described below) and pressurizing it to ensure a consistent flow of the oil. The oil forms a thin film between the moving parts, reducing wear and ensuring smooth operation. After lubricating, the oil follows a return back to the oil reservoir allowing for the collection of excess oil and ensuring that the oil circulation remains a continuous cycle. The oil filter is an integral component of the oil circulation arrangement. the oil filter is positioned in line with the oil flow, the oil filter captures contaminants and impurities present in the oil. It prevents these contaminants from circulating within the system, ensuring that only clean oil reaches the sealing system of the azimuth thruster.

The azimuthing seal (also referred to as azimuth thruster seal), is a sealing system used in azimuth thrusters. The azimuthing seal ensures the integrity between the stationary upper body and the rotating lower body of the Azimuth thruster. The azimuthing seal is configured to prevent oil leakage and water ingress into the thruster system and maintains a watertight and oil-tight barrier, protecting the internal components from external elements such as seawater and contaminants. The azimuthing seal is designed to withstand the dynamic forces and extreme operating conditions experienced by the azimuth thruster, including high rotational speeds, variable loads, and hydrostatic pressures.

The azimuthing seal includes stationary housing, a rotating part, sealing elements, and sealing mechanisms. The stationary housing is fixed to the vessel's structure and houses the sealing elements. The rotating hub, attached to the propeller shaft, rotates with the propeller and interfaces with the stationary housing to form a seal. The sealing elements are designed to withstand the forces and movements encountered during operation while maintaining a reliable and effective seal. The sealing mechanisms, such as spring-loaded or hydraulic systems, ensure proper contact and pressure between the sealing elements and the mating surfaces, optimizing the sealing performance.

The propeller shaft seal (also referred to as shaft sealing system) is responsible for sealing the area where the propeller shaft exits the thruster housing, preventing water ingress and ensuring the efficient operation of the propulsion system. The propeller shaft seal is arranged to create a watertight barrier around the propeller shaft to prevent seawater from entering the Azimuth thruster. The propeller shaft shaft seal is also configured to retain the oil within the azimuth thruster.

The propeller shaft seal includes stationary and rotating components. The stationary part is fixed to the azimuth thruster housing and incorporates sealing elements that create a tight seal around the propeller shaft. The rotating component is attached to the propeller shaft and rotates therewith, allowing smooth and unrestricted shaft rotation while maintaining integrity. In particular, the oil is supplied to the seal through the oil filtration and lubrication system, ensuring that the seal surfaces of the propeller shaft seal remain well-lubricated and protected. Beneficially, the lubrication of the propeller shaft seal helps to minimize wear, heat generation, and potential damage to the sealing elements, ensuring the longevity and reliability of the propeller shaft seal.

The lubrication system is configured to flow both unfiltered oil and filtered oil. Typically, the different pathways are arranged for both unfiltered oil and filtered oil. The unfiltered oil is drawn from the reservoir and directed through a passage that bypasses the filtration mechanism. This allows the unfiltered oil to flow directly to the components of the azimuth thruster.

The flow rate of the unfiltered oil is less than a predefined flow rate. The rate at which the unfiltered oil is flowing is slower than a specific flow rate that has been predetermined. The predefined flow rate provides a reference for the desired flow rate of the unfiltered oil. The term "flow rate" refers to the speed of the unfiltered oil, that is flowing through a pathway in the oil filtration and lubrication system. Optionally, the predefined flow rate lies in a range of 0.1 litres per minute-1 litre per minute. Optionally, the predefined flow rate lies in a range of 0.1, 0.3, 0.4, 0.5, 0.6, 0.7, 0.8 or 0.9 up to 0.3, 0.4, 0.5, 0.6, 0.7, 0.8, 0.9, 1 litre per minute. The unfiltered oil flows at a flow rate between 0.1-1 litre per minute.

Optionally, the oil filtration and lubrication system further comprises:

- at least one first sensor for detecting presence of at least one of: the impurities, water, in at least one of: the unfiltered oil, the filtered oil;
- at least one indicator; and
- at least one first processor communicably coupled to the at least one first sensor and the at least one indicator, wherein the at least one first processor is configured to:
  - receive first sensor data from the at least one first sensor;
  - determine whether the first sensor data is indicative of the presence of at least one of: the impurities, the water; and
  - control the at least one indicator to provide a first indication, when it is determined that the first sensor data is indicative of the presence of at least one of: the impurities, the water.

In this regard, the at least one first sensor is arranged for detecting the filtered oil and the unfiltered oil. The sensor is a device, module, machine, or subsystem that detects the presence of impurities or water in the oil (such as filtered and unfiltered oil). The at least one first sensor is designed to assess the quality of the oil by detecting impurities and water that may affect its performance or cause potential damage to the system. Optionally, the at least one first sensor may be an optical sensor, where the said sensor uses light or laser beams to analyse the oil and identify the presence of impurities. By measuring the light transmission or reflection, the sensor can determine the concentration or size of the impurities present. In another embodiment the at least one first sensor may be an electrical sensor, based on electrical conductivity or resistance the sensor can assess the electrical properties of the oil to detect the presence of conductive or non-conductive particles. The electrical sensor enables the identification of metallic contaminants or conductive debris. In yet another embodiment, the at least one first sensor may be the ultrasonic sensor. The said sensor utilises ultrasonic waves to detect impurities and analyse the change in frequency to identify the presence of impurities in the oil.

When impurities are detected, the oil filtration and lubrication system include the at least one indicator. The at least one indicator is operatively coupled to sensors that measure parameters such as oil pressure, flow rate, temperature, or the presence of impurities. Based on the readings from the at least one first sensor. Beneficially, the at least one indicator provides a signal when the oil filter is becoming clogged or is saturated with impurities. For example, the at least one indicator indicates a drop in oil pressure, a blockage in the filter, or a malfunctioning of the at least one first sensor. This serves as a prompt for maintenance or replacement, ensuring that the oil filter is functioning optimally and continuing to remove contaminants effectively. The at least one indicator may display a visual warning, such as a coloured light or a symbol, or it may emit an audible alarm to alert. The at least one first sensor and the at least one indicator are communicably coupled to the at least one first processor.

The term "processor" refers to a computational element that is operable to respond to and processes instructions that is received from the at least one first sensor. The processor includes but is not limited to, a microprocessor, a microcontroller, a complex instruction set computing (CISC) microprocessor, a reduced instruction set (RISC) microprocessor, a very long instruction word (VLIW) microprocessor, or any other type of processing circuit. Furthermore, the least one processor may refer to one or more individual processors, processing devices and various elements associated with a processing device that may be shared by other processing devices.

The at least one first processor receives the first sensor data from the at least one first sensor. The first sensor data is the representation of the presence of the one of: the impurities, the water sensed by the at least one first sensor in the filtered oil or the unfiltered oil. Moreover, the at least one first processor is configured to determine whether the first sensor data is indicative of the presence of the impurities or the water or both. Furthermore, the at least one first processor control the at least one indicator to provide the first indication. The first indication is may be a visual warning, such as a light or a symbol, or it may emit an audible alarm when it is determined that the first sensor data is indicative of the presence of at least one of: the impurities, the water.

Optionally, the at least one first processor is further configured to control the at least one indicator to provide a second indication when the first sensor data is also indicative of at least one of: an amount of the impurities, the size of the impurities, an amount of the water, being above its corresponding predefined threshold. In this regard, the at least one first processor is programmed to regulate the at least one indicator to provide the second indication. The second indication is triggered when the first sensor data suggests that the level or quantity of impurities, the size of the impurities, or the amount of water present in the oil has surpassed their predetermined thresholds.

The second indication may be a visual alert, such as a warning light or symbol, or an audible signal, such as an alarm or beep. Similarly, if the first sensor data indicates that the size of the impurities present in the system exceeds the predefined threshold, the at least one first processor triggers the at least one indicator to provide the second indication. Furthermore, when the first sensor data reveals that the amount of water in the oil exceeds its predefined threshold, the at least processor instructs the at least one indicator to provide the second indication. A technical effect of the second indication is that it provides an indication when the impurity level, impurity size, or water content exceeds their corresponding predefined thresholds to enable proactive response to critical conditions, allowing for timely maintenance and mitigation measures to be undertaken. For example, if the predefined threshold of relative humidity of oil is less than equal to 50%, however if the relative humidity of oil reaches 80% then the at least one indicator to provide the second indication.

Optionally, the oil filtration and lubrication system is integrated into a closed loop system in which the oil circulation arrangement fluidically couples an oil tank, the oil filter, and the at least one of: azimuthing seal, the propeller shaft seal, with each other. In this regard, the oil circulation arrangement fluidically coupled to the oil tank, oil filter, and the at least one of: azimuthing seal, the propeller shaft seal, with each other forming the closed loop. In this case, the oil circulation arrangement receives the unfiltered oil from the oil tank, passes the filtered oil from the oil filter to the at least one of: the steering tube seal, the propeller shaft seal, and directs contaminated oil including impurities from the at least one of: the steering tube seal, the propeller shaft seal, into the oil tank, wherein such contaminated oil serves as the unfiltered oil for a next cycle of oil filtration. In particular, the oil tank is responsible for storing an adequate supply of oil required for lubrication and filtration within the system. It serves as the reservoir from which the oil is drawn and circulated throughout the system to provide lubrication and cooling to the relevant components. The oil filter is responsible for removing impurities and contaminants from the oil. It is designed to trap particles and debris, ensuring that the oil remains clean and free. The filtered oil is then directed to the desired areas where lubrication is required.

The oil circulation arrangement facilitates the flow of oil between the oil tank, oil filter, azimuthing seal or propeller shaft seal. The oil circulation arrangement ensures that the oil is efficiently transported from the oil tank to the oil filter for purification and then distributed to the azimuthing seal and the propeller shaft seal. The azimuthing seal and the propeller shaft seal are positioned to prevent oil from escaping or entering unwanted areas, ensuring the integrity of the system and minimizing the risk of external contamination or lubricant loss. The oil filtration and lubrication system are integrated into a closed-loop arrangement with a fluidic coupling that operates in a continuous and controlled manner. The oil is circulated, filtered, and directed to the components, while the seals ensure effective containment and prevent any unintended oil leakage. A technical effect of the closed-loop system is that it ensures a consistent supply of clean and filtered oil, promoting efficient lubrication, cooling, and overall performance of the azimuth thruster.

Optionally, the oil circulation arrangement comprises:

a first piping system for fluidically coupling an oil tank with the azimuthing seal, via the oil filter; and a second piping system for fluidically coupling the oil tank with the propeller shaft seal, via the oil filter.

In this regard, the term "first piping and second piping" refers to a network of pipes, fittings, valves, and other components that are interconnected to facilitate the transport of oil from one location to another. The first piping system and the second system are designed to ensure the controlled and efficient flow of oil within the oil circulation arrangement.

The first piping system in the oil filtration and lubrication system is responsible for fluidically connecting the oil tank to the azimuthing seal, through the oil filter. The piping system serves as the conduit through which the oil flows, ensuring a seamless transfer of the oil therebetween. The first piping system directs the oil towards the oil filter. The oil filter removes impurities and contaminants from the oil, ensuring that only clean and filtered oil reaches the azimuthing seal. Once the oil reaches the oil filter through the first piping system, it undergoes the filtration process, where impurities and contaminants are removed. The oil filter traps particles and debris having a size of down to 0.1 micrometre. The azimuthing seal provides a secure barrier and prevents oil leakage, ensuring the oil is contained within the system.

The second piping system in the oil filtration and lubrication system fluidically connects the oil tank with the propeller shaft seal through the oil filter. The second piping system ensures the smooth and controlled flow of oil therebetween, enabling efficient lubrication and sealing of the propeller shaft. The first piping system directs the oil towards the oil filter. The oil filter removes impurities and contaminants from the oil, ensuring clean and filtered oil reaches the propeller shaft seal. The oil reaches the oil filter through the second piping system, it undergoes the filtration process. The oil filter captures particles, debris, and contaminants having a size down to 0.1 micrometre and allows clean oil to pass through and ensures that the oil reaches the propeller shaft seal free from contaminants that could impair the functionality or cause damage.

After passing through the oil filter, the filtered oil is then directed to the propeller shaft seal. The propeller shaft is configured to prevent oil leakage and maintains a secure seal around the propeller shaft. The second piping system ensures that the filtered oil reaches the propeller shaft seal, providing the necessary lubrication and sealing properties. By incorporating the second piping system in the oil filtration and lubrication system, a seamless flow of oil is established from the oil tank to the propeller shaft seal, with the oil filter acting as an intermediate step. A technical effect of the first piping system and the second piping system in the oil filtration and lubrication system is that it enables the seamless transfer of oil from the oil tank to the azimuthing seal and the propeller shaft seal, respectively, via the oil filter and ensures that the oil is properly filtered to remove impurities, promoting efficient lubrication and protecting the azimuthing seal and the propeller shaft seal from potential damage or contamination.

Optionally, the oil circulation arrangement further comprises at least one first valve arranged in the first piping system and at least one second valve arranged in the second piping system, and wherein the oil filtration and lubrication system further comprises:

at least one second sensor that monitors an operational status of at least one of: the azimuthing seal, the propeller shaft seal, of the azimuth thruster; and at least one second processor communicably coupled to the at least one second sensor, wherein the at least one first processor is configured to:

receive second sensor data from the at least one second sensor;

determine whether the at least one of: the azimuthing seal, the propeller shaft seal, is in operation, based on the second sensor data;

control at least one of: the at least one first valve, the at least one second valve, for enabling oil flow within the at least one of: the first piping system, the second piping system, when it is determined that the at least one of: the azimuthing seal, the propeller shaft seal, is in operation, respectively.

In this regard, the term "first valve and second valve" refers to a device that is configured to control and regulate the flow of oil within the piping system. The at least one first valve and second valve are designed to start, stop, or adjust the flow of the oil by opening or closing the passage of the first piping system and the second piping system. Optionally, the valves may be selected but not limited to gate valves, ball valves, globe valves, butterfly valves, check valves, and control valves. The oil filtration and lubrication system include the at least one second sensor that monitors operational status and monitors the working of the least one of: the azimuthing seal, the propeller shaft seal of the azimuth thruster. Moreover, the at least one second sensor is similar to the at least one first sensor. However, the at least one second sensor is arranged in the close vicinity of the azimuthing seal and propeller shaft seal for monitoring the operation of the azimuthing seal, the propeller shaft seal of the azimuth thruster.

Moreover, the oil filtration and lubrication system also include the at least one second processor. The at least one second process is similar to that of the at least one first process. However, the at least one second processor is configured to receive second sensor data from the at least one second sensor. The second sensor data is the information associated with the operation of the steering sealing system and/or the propeller. The at least one second processor is further configured to control the at least one first valve, the at least one second valve, for enabling oil flow within the at least one of: the first piping system, the second piping system, when it is determined that the at least one of: the azimuthing seal, the propeller shaft seal, is in operation, respectively.

Optionally, the at least one second sensor also determines a rotational speed of the at least one of: the azimuthing seal, the propeller shaft seal, in operation, and wherein the at least one first processor is further configured to control the at least one of: the at least one first valve, the at least one second valve, respectively, for enabling the oil flow at a flow rate corresponding to the rotational speed. In this regard, the at least one second sensor measures the rotational speed of the azimuthing seal and/or the propeller when in operation. The at least one first processor is configured to control the at least one first valve and the at least one second valve to enable the flow of oil at a rate that corresponds to the rotational speed thereof.

Moreover, the at least one second sensor is also configured for determining the rotational speed of the azimuthing seal and/or the propeller shaft seal when in operation. This at least one second sensor provides data corresponding to the speed of rotation. The at least one second processor is arranged to control the operation of the at least one first valve and the at least one second valve to regulate the flow of oil. The at least one second processor is configured to adjust and control the at least one first valve and the at least one second valve accordingly based on the rotational speed obtained from the at least one second sensor.

Optionally, by synchronizing the rotational speed with the oil flow rate, the at least one first processor ensures that the lubricating oil is supplied to the components at a rate that matches the operation of the azimuthing seal and the propeller shaft seal. The at least one first valve and the at least one second valve work in tandem to enable the desired oil flow rate. They may open or close to modulate the oil flow, allowing for a sufficient amount of oil to reach based on the rotational speed. The said dynamic adjustment ensures that the lubrication system operates optimally, promoting efficient lubrication, cooling, and protection against wear and tear.

The at least one second sensor senses the rotational speed, and at least one first processor controls the at least one first and second valve, establishing a feedback loop within the system. The at least one second sensor continuously provides real-time data on the rotational speed, and the at least one first processor interprets this information to adjust the valve positions and oil flow rate accordingly. A technical effect of controlling the at least one first valve and the at least one second valve is that it allows for adjustment of the oil flow rate based on the rotational speed that helps in optimising lubrication and cooling, thus promoting efficient operation.

The present disclosure also relates to the system as described above. Various embodiments and variants disclosed above, with respect to the aforementioned oil filtration and lubrication system, apply mutatis mutandis to the system.

Optionally, the oil filtration and lubrication system is formed inside the azimuth thruster. In this regard, the oil filtration and lubrication system are integrated and incorporated within the azimuth thruster. By forming the oil filtration and lubrication system inside the azimuth thruster allows a compact and streamlined design, reducing the overall footprint and complexity of the system. The integration eliminates the need for external piping, connections, and additional equipment, simplifying installation and reducing potential points of failure or leakage.

Moreover, forming the oil filtration and lubrication system inside the azimuth thruster promotes efficient oil flow and distribution, ensuring effective filtration, lubrication, and cooling of the components. Also, it provides better protection and containment of the oil. Furthermore, forming the oil filtration and lubrication system inside the azimuth thruster facilitates better monitoring and maintenance and it becomes more accessible for inspection, servicing, and replacement of components. A technical effect of forming the oil filtration and lubrication system inside the azimuth thruster is that it provides a compact design, optimized oil flow, enhanced protection, and improved maintenance capabilities.

The present disclosure also relates to the method as described above. Various embodiments and variants disclosed above, with respect to the aforementioned oil filtration and lubrication system and the aforementioned system, apply mutatis mutandis to the method.

DETAILED DESCRIPTION OF THE DRAWINGS

Referring to FIG. 1, illustrated is a schematic view of an oil filtration and lubrication system 100 for a sealing system of an azimuth thruster, in accordance with an embodiment of the present disclosure. As shown, the oil filtration and lubrication system 100 comprises an oil filter 102 comprising a plurality of layers 104 of a filter material. The plurality of layers being arranged within an oil filtration chamber 106 such that adjacent layers amongst the plurality of layers have a predefined distance 108 therebetween. The oil filtration and lubrication system 100 includes an oil circulation arrangement 110.

Moreover, when the oil filtration and lubrication system 100 is in use, the oil circulation arrangement 110 enables passage of unfiltered oil 112 between the layers of the oil filter 102, at a flow rate which is less than a predefined flow rate, the oil filter 102 removes impurities from the unfiltered oil 112, and then filtered oil 114 is passed from the oil filter 102 to the sealing system of the azimuth thruster, by the oil circulation arrangement 110. Moreover, the filtered oil 114 lubricates at least one of: an azimuthing seal 116, a propeller shaft seal 118, of the azimuth thruster. Furthermore, the oil filter 102 is configured to remove impurities from the oil, which impurities have a size of equal or smaller than 0.1 micrometre.

Figure 2:
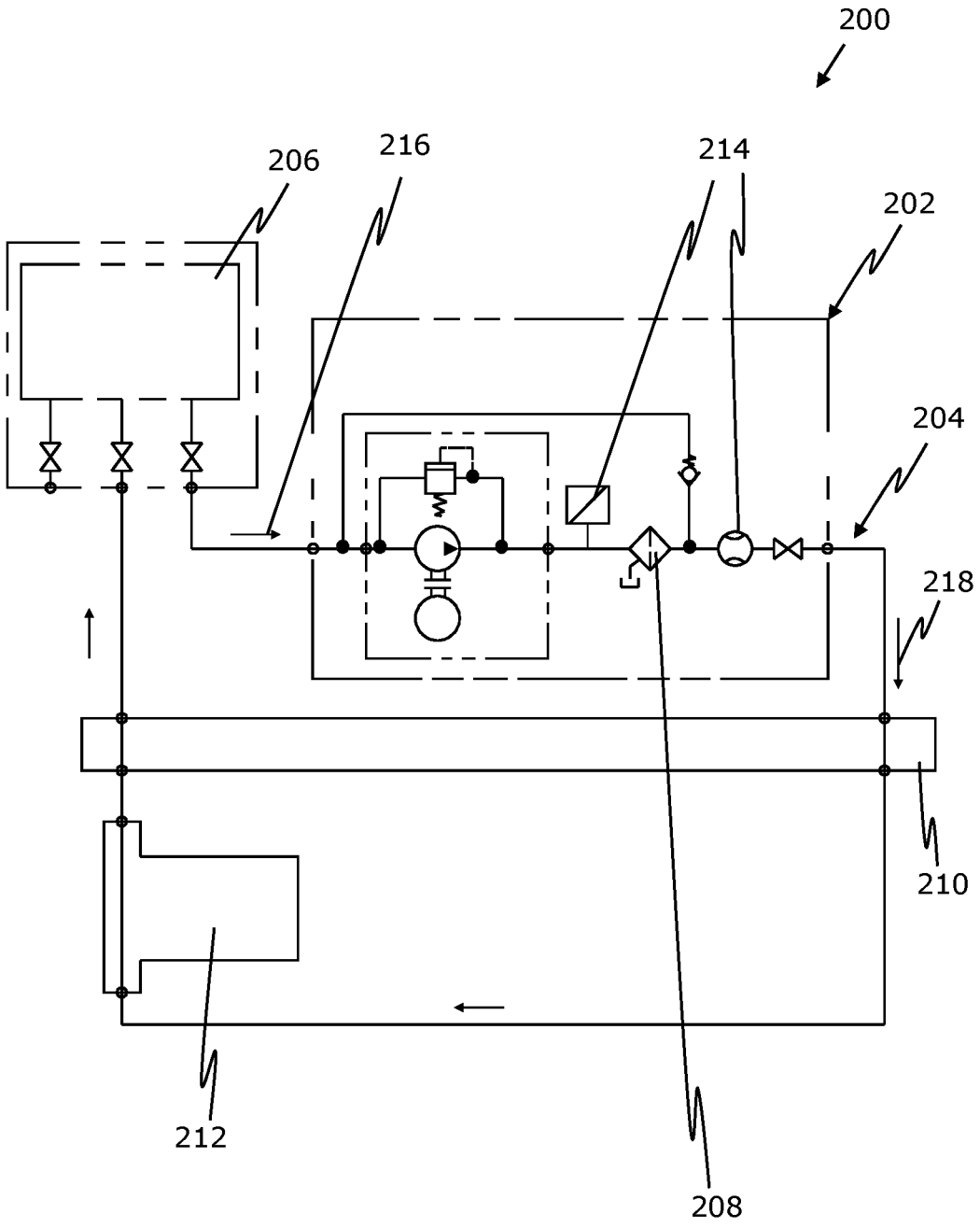
FIG. 2 is a schematic view of an oil filtration and lubrication system integrated into a closed loop system, in accordance with an embodiment of the present disclosure.

Referring to FIG. 2, illustrated is a schematic view of an oil filtration and lubrication system 200 integrated into a closed loop system 202, in accordance with an embodiment of the present disclosure. The oil circulation arrangement 204 fluidically couples an oil tank 206, an oil filter 208, and the at least one of: the azimuthing seal 210, the propeller shaft seal 212, with each other. Moreover, optionally, the oil circulation arrangement 204 comprises a first piping system for fluidically coupling an oil tank 206 with the azimuthing seal 210, via the oil filter 208 and a second piping system for fluidically coupling the oil tank 206 with the propeller shaft seal 212, via the oil filter 208.

The oil filtration and lubrication system 200 includes at least one first sensor 214 for detecting presence of at least one of: the impurities, water, in at least one of: an unfiltered oil 216, a filtered oil 218, at least one indicator and at least one processor communicably coupled to the at least one first sensor 214 and the at least one indicator. The at least one processor is configured to receive first sensor data from the at least one sensor 214, determine whether the first sensor data is indicative of the presence of at least one of: the impurities, the water and control the at least one indicator to provide a first indication, when it is determined that the first sensor data is indicative of the presence of at least one of: the impurities, the water. The oil circulation arrangement 204 further comprises at least one first valve (not shown) arranged in the first piping system and at least one second valve (not shown) arranged in the second piping system.

Figure 3A:
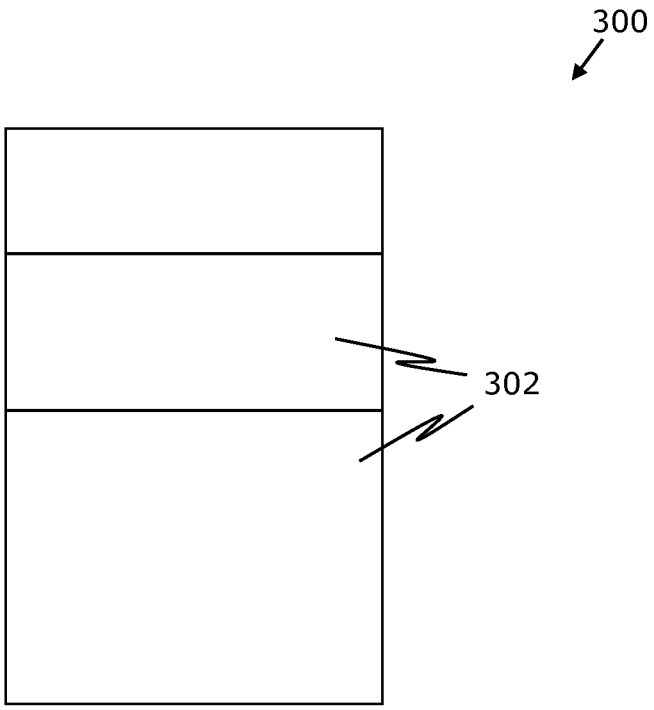
FIGS. 3A and 3B are side view and perspective view, respectively, of an oil filter, in accordance with an embodiment of the present disclosure.
Figure 3B:
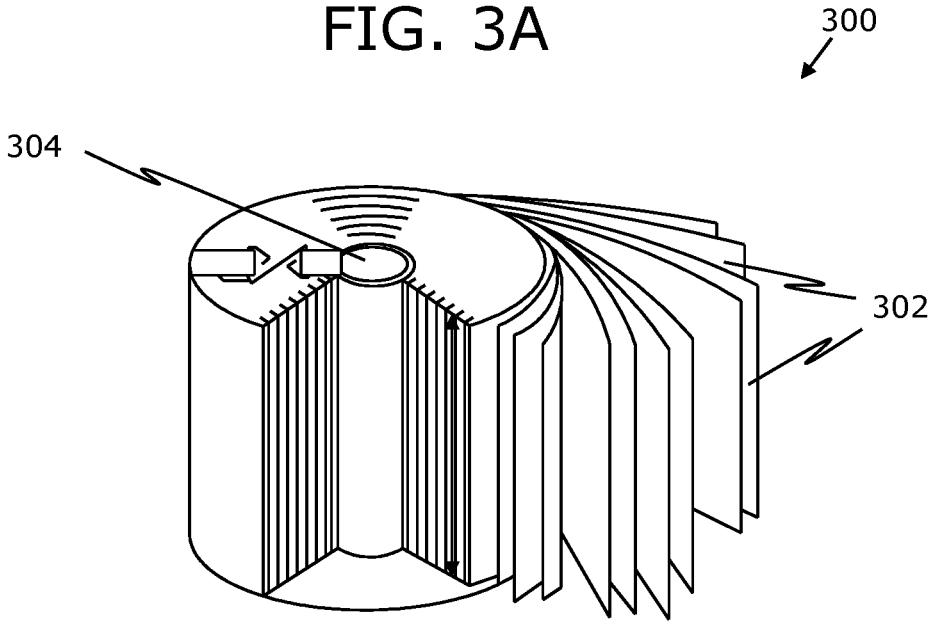

Referring to FIGS. 3A and 3B are side view and perspective view, respectively, of an oil filter 300, in accordance with an embodiment of the present disclosure. The oil filter 300 comprises the plurality of layers 302 of the filter material. As shown in FIG. 3A, the plurality of layers of the filter material is stacked on top of each other to form the oil filter 300. increases the surface area available for capturing and trapping contaminants. Notably, each layer provides a surface for impurities to be captured, allowing for an improved capacity. As shown in FIG. 3B, the oil filter 300 has the plurality of layers 302 of the filter material arranged adjacent to each other have a predefined distance. The oil filter comprises a central core 304, which provides stability and support to the adjacently.

Figure 4:
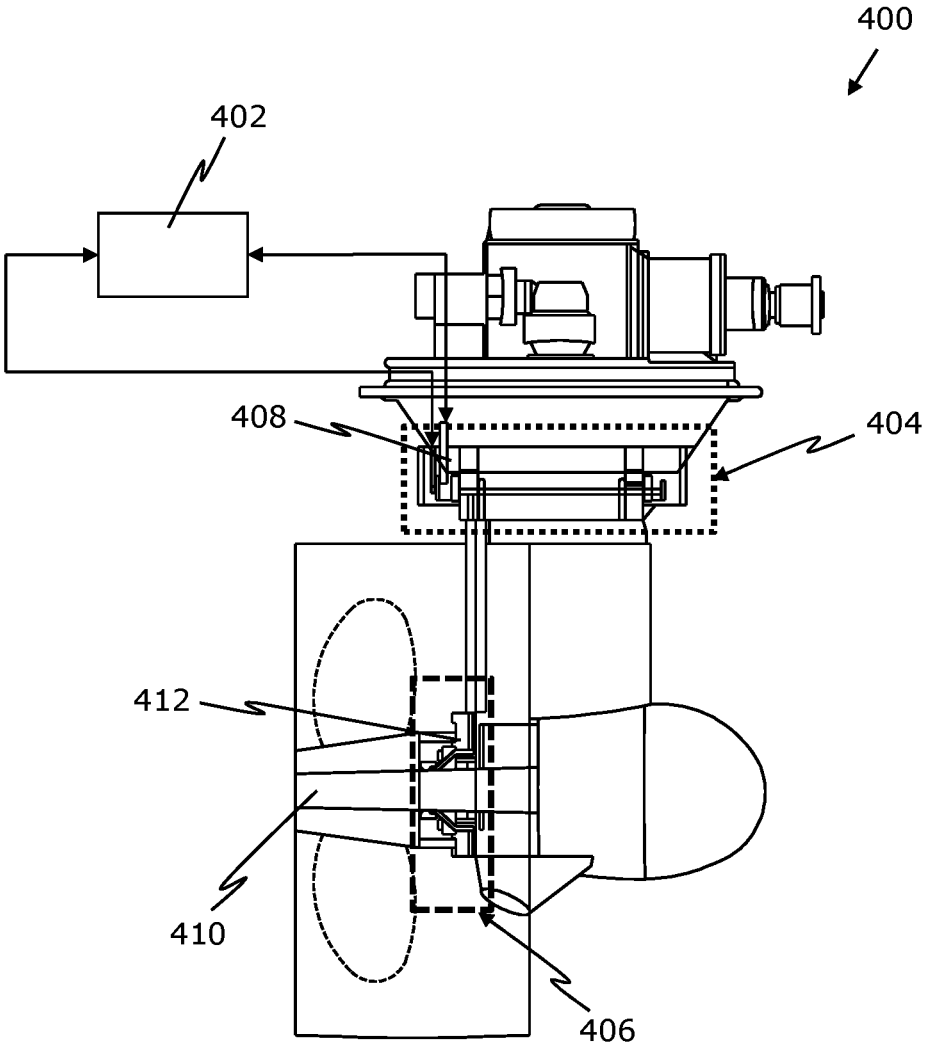
FIG. 4 is a cross-sectional view of an azimuth thruster, in accordance with an embodiment of the present disclosure.

Referring to FIG. 4, illustrated is a cross-sectional view of an azimuth thruster 400, in accordance with an embodiment of the present disclosure. As shown, an oil tank 402 fluidically couples with the azimuthing seal 404 (depicted as dotted line) and the propeller shaft seal 406 (depicted as dashed line). The azimuthing seal 404 ensures a watertight and secure seal, preventing water ingress and maintaining the integrity of the azimuth thruster 400. The is arranged at the interface between the rotating components of an azimuth thruster 400 and the stationary components. The azimuth seal 404 is positioned within an azimuthing seal housing 408 that surrounds the rotating parts of the azimuth thruster 400. The azimuthing seal housing 408 is securely mounted to the stationary components, ensuring proper alignment and positioning of the sealing elements.

The propeller shaft seal 406 is arranged around the propeller shaft 410 of the azimuth thruster 400. The propeller shaft seal 406 is positioned within a propeller shaft seal housing 412 that surrounds the propeller shaft 410. The propeller shaft seal housing 412 is mounted on the hull of the azimuth thruster 400 and is located at the point where the propeller shaft exits the hull into the water. The propeller shaft seal 406 is designed to create a watertight barrier between the propeller shaft 410 and the surrounding water, preventing water from entering the azimuth thruster 400.

Figure 5:
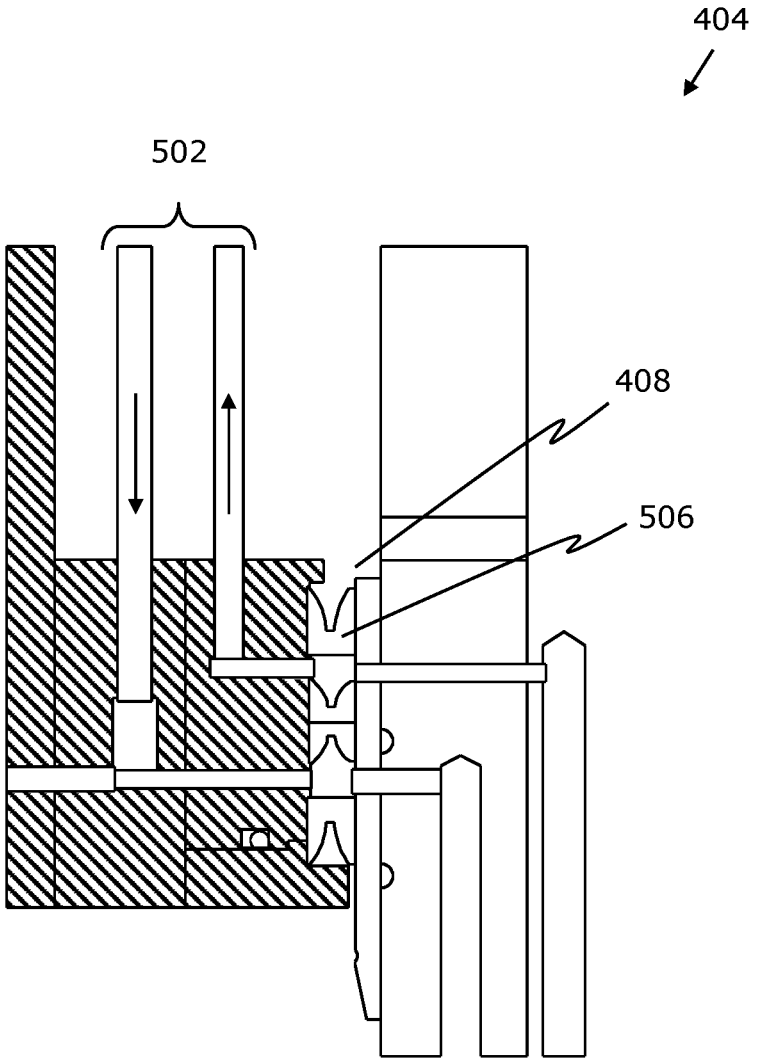
FIG. 5 is a sectional view of the azimuthing seal, in accordance with the embodiment of the present disclosure.

Referring to FIG. 5, illustrated is a sectional view of the azimuthing seal 404, in accordance with the embodiment of the present disclosure. As shown, the azimuth thruster includes a first piping system 502 for fluidically coupling an oil tank with the azimuthing seal 404 via the oil filter. The azimuthing seal 404 includes the azimuthing seal housing 408 surrounding the sealing element 506. The sealing element 506 provides a secure enclosure and ensures the proper alignment and positioning. The azimuthing seal housing 408 helps to contain any potential leaks and maintain the integrity of the azimuthing seal 404 under various operating conditions.

Figure 6:
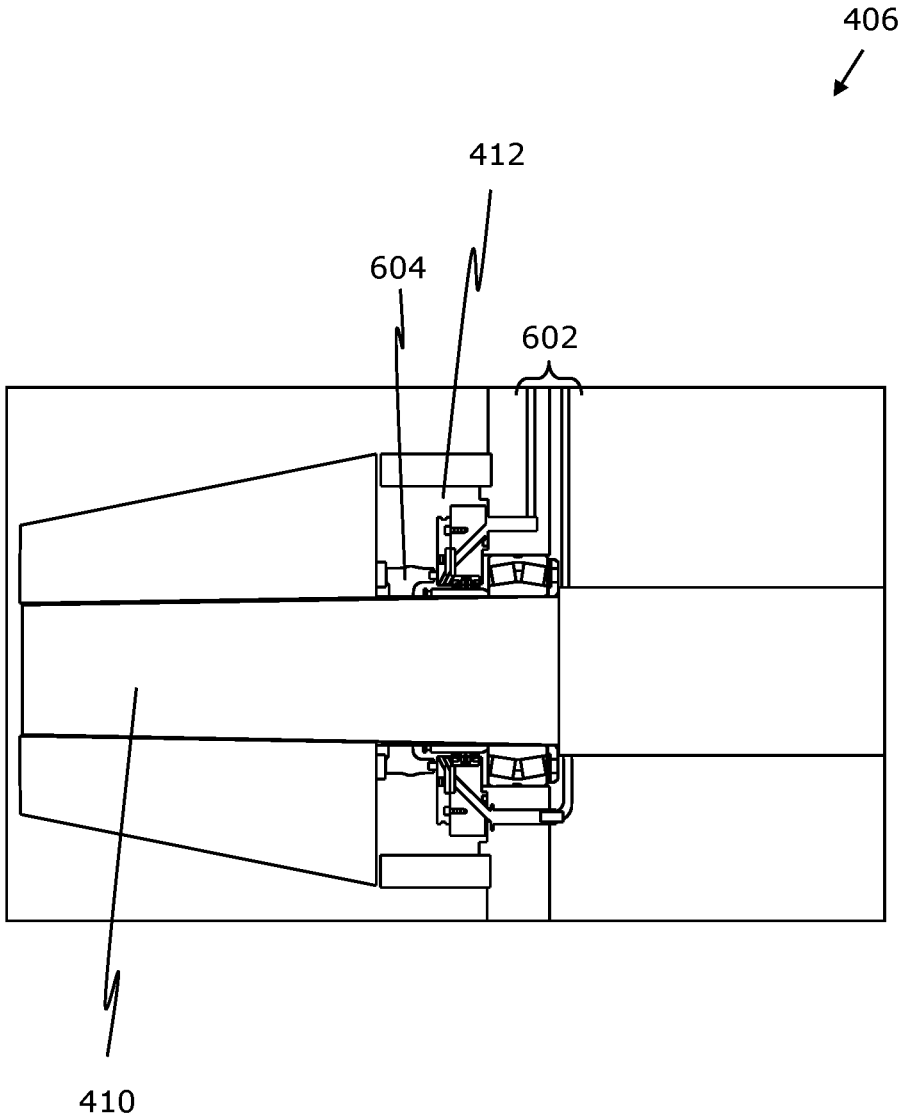
FIG. 6 is a sectional view of the propeller shaft seal, in accordance with the embodiment of the present disclosure.

Referring to FIG. 6, illustrated is a sectional view of the propeller shaft seal 406, in accordance with the embodiment of the present disclosure. As shown, the azimuth thruster includes a second piping system 602 for fluidically coupling the oil tank with the propeller shaft seal 406, via the oil filter. The propeller shaft seal 406 includes a propeller shaft seal housing 412 configured to provide a protective enclosure around the propeller shaft 410. Moreover, the propeller shaft seal 406 includes a sealing element 604 fabricated from rubber or synthetic compounds, for creating a tight seal around the propeller shaft 410. As the propeller shaft 410 rotates, the sealing elements 604 in the propeller shaft seal housing 412 form seal around the propeller shaft 410.

Figure 7:
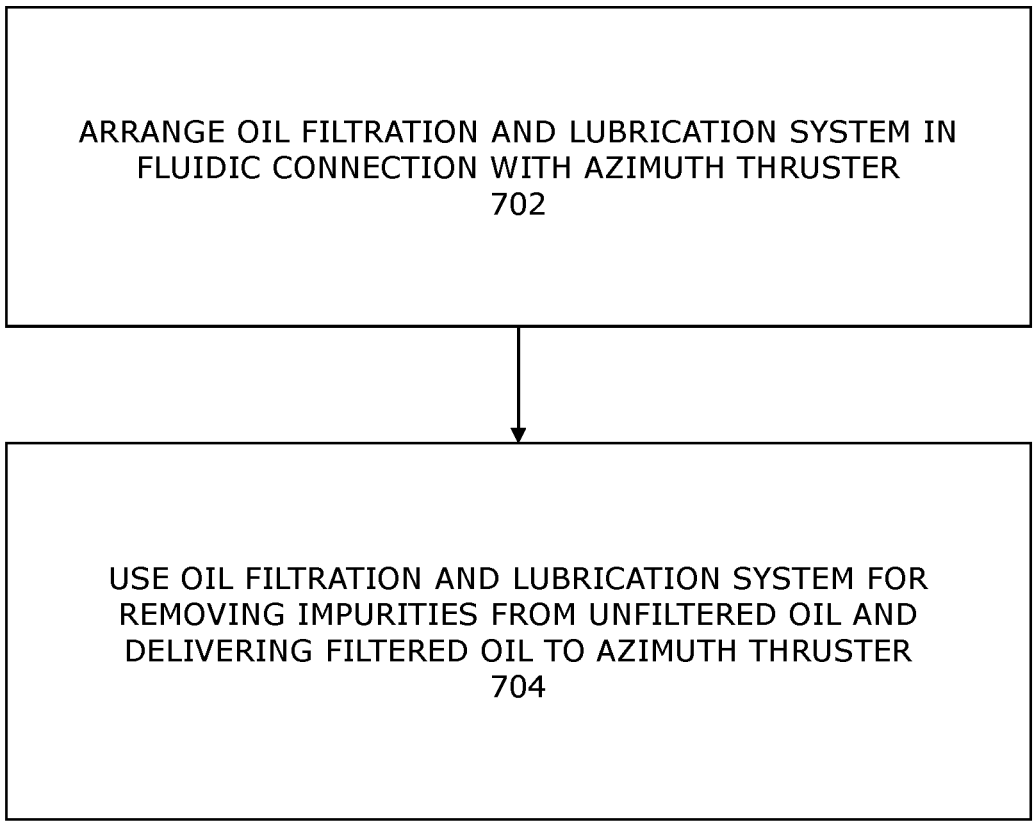
FIG. 7 is a flowchart of a method illustrating steps for implementing an oil filtration and lubrication system in accordance with the aspects of the disclosed embodiments.

Referring to FIG. 7, there is shown a flowchart of a method illustrating steps for implementing such oil filtration and lubrication system, in accordance with an embodiment of the present disclosure. At step, 702 an oil filtration and lubrication system is arranged in fluidic connection with an azimuth thruster. At step, 704 the oil filtration and lubrication system is used for removing impurities from unfiltered oil, and delivering filtered oil to the azimuth thruster. as operational mode for an electric drive is selected.

The steps 702 and 704 are only illustrative and other alternatives can also be provided where one or more steps are added, one or more steps are removed, or one or more steps are provided in a different sequence without departing from the scope of the claims herein.

The invention claimed is:

1. An oil filtration and lubrication system for a sealing system of an azimuth thruster, the oil filtration and lubrication system comprising:

an oil filter comprising a plurality of layers of a filter material, the plurality of layers being arranged within an oil filtration chamber such that adjacent layers amongst the plurality of layers have a predefined distance therebetween; and an oil circulation arrangement comprising:

a first piping system for fluidically coupling an oil tank with an azimuthing seal via the oil filter; and a second piping system for fluidically coupling the oil tank with a propeller shaft seal via the oil filter, and wherein the oil filtration and lubrication system is integrated into a closed loop system in which the oil circulation arrangement fluidically couples the oil tank, the oil filter, and at least one of: the azimuthing seal or the propeller shaft seal, with each other; and when the oil filtration and lubrication system is in use, the oil circulation arrangement enables passage of unfiltered oil between the layers of the oil filter, at a flow rate which is less than a predefined flow rate, wherein the oil filter removes impurities from the unfiltered oil, and filtered oil is passed from the oil filter to the sealing system of the azimuth thruster, by the oil circulation arrangement, and wherein the filtered oil lubricates at least one of: the azimuthing seal, the propeller shaft seal, of the azimuth thruster, and wherein the impurities removed from the unfiltered oil have a size down to 0.1 micrometre.

2. The oil filtration and lubrication system according to claim 1, wherein the predefined flow rate lies in a range of 0.1 litres per minute-1 litre per minute.

3. The oil filtration and lubrication system according to claim 1, wherein the predefined distance lies in a range of 10-50 micrometres.

4. The oil filtration and lubrication system according to claim 1, wherein a length of a given layer amongst the plurality of layers of the filter material, along a direction of oil flow through the oil filtration chamber, lies in a range of 10-100 cm.

5. The oil filtration and lubrication system according to claim 1, wherein the filter material is at least one of: cellulose, fibreglass, paper, textile, a composite fibre, or a combination of the aforementioned.

6. The oil filtration and lubrication system according to claim 1, further comprising:

at least one first sensor for detecting presence of at least one of: the impurities, water, in at least one of: the unfiltered oil, the filtered oil;

at least one indicator; and at least one first processor communicably coupled to the at least one first sensor and the at least one indicator, wherein the at least one first processor is configured to:

receive first sensor data from the at least one first sensor;

determine whether the first sensor data is indicative of the presence of at least one of: the impurities, the water; and control the at least one indicator to provide a first indication, when it is determined that the first sensor data is indicative of the presence of at least one of: the impurities, the water.

7. The oil filtration and lubrication system according to claim 6, wherein the at least one first processor is further configured to control the at least one indicator to provide a second indication when the first sensor data is also indicative of at least one of: an amount of the impurities, a size of the impurities, an amount of the water, being above its corresponding predefined threshold.

8. The oil filtration and lubrication system according to claim 1, wherein the oil circulation arrangement further comprises at least one first valve arranged in the first piping system and at least one second valve arranged in the second piping system, and wherein the oil filtration and lubrication system further comprises:

at least one second sensor that monitors an operational status of at least one of: the azimuthing seal, the propeller shaft seal, of the azimuth thruster; and at least one second processor communicably coupled to the at least one second sensor, wherein the at least one first processor is configured to:

receive second sensor data from the at least one second sensor;

determine whether the at least one of: the azimuthing seal, the propeller shaft seal, is in operation, based on the second sensor data;

control at least one of: the at least one first valve, the at least one second valve, for enabling oil flow within the at least one of: the first piping system, the second piping system, when it is determined that the at least one of: the azimuthing seal, the propeller shaft seal, is in operation, respectively.

9. The oil filtration and lubrication system according to claim 8, wherein the at least one second sensor also determines a rotational speed of the at least one of: the azimuthing seal, the propeller shaft seal, in operation, and wherein the at least one first processor is further configured to control the at least one of: the at least one first valve, the at least one second valve, respectively, for enabling the oil flow at a flow rate corresponding to the rotational speed.

10. A system comprising an azimuth thruster and an oil filtration and lubrication system for the azimuth thruster, the oil and filtration lubrication system comprising:

an oil filter comprising a plurality of layers of a filter material, the plurality of layers being arranged within an oil filtration chamber such that adjacent layers amongst the plurality of layers have a predefined distance therebetween; and an oil circulation arrangement comprising:

a first piping system for fluidically coupling an oil tank with an azimuthing seal via the oil filter; and a second piping system for fluidically coupling the oil tank with a propeller shaft seal via the oil filter, and wherein the oil filtration and lubrication system is integrated into a closed loop system in which the oil circulation arrangement fluidically couples the oil tank, the oil filter, and at least one of: the azimuthing seal or the propeller shaft seal, with each other; and when the oil filtration and lubrication system is in use, the oil circulation arrangement enables passage of unfiltered oil between the layers of the oil filter at a flow rate which is less than a predefined flow rate, wherein the oil filter removes impurities from the unfiltered oil, and filtered oil is passed from the oil filter to the sealing system of the azimuth thruster by the oil circulation arrangement, and wherein the filtered oil lubricates at least one of: the azimuthing seal, the propeller shaft seal, of the azimuth thruster, and wherein the impurities removed from the unfiltered oil have a size down to 0.1 micrometre.

11. The system according to claim 10, wherein the oil filtration and lubrication system is formed inside the azimuth thruster.

12. A method comprising:

arranging an oil filtration and lubrication system in fluidic connection with an azimuth thruster, wherein the oil and lubrication system comprises:

an oil filter comprising a plurality of layers of a filter material, the plurality of layers being arranged within an oil filtration chamber such that adjacent layers amongst the plurality of layers have a predefined distance therebetween; and an oil circulation arrangement comprising:

a first piping system for fluidically coupling an oil tank with an azimuthing seal via the oil filter; and a second piping system for fluidically coupling the oil tank with a propeller shaft seal via the oil filter, and wherein the oil filtration and lubrication system is integrated into a closed loop system in which the oil circulation arrangement fluidically couples the oil tank, the oil filter, and at least one of: the azimuthing seal or the propeller shaft seal, with each other; and when the oil filtration and lubrication system is in use, the oil circulation arrangement enables passage of unfiltered oil between the layers of the oil filter at a flow rate which is less than a predefined flow rate, wherein the oil filter removes impurities from the unfiltered oil, and filtered oil is passed from the oil filter to the sealing system of the azimuth thruster by the oil circulation arrangement, and wherein the filtered oil lubricates at least one of: the azimuthing seal, the propeller shaft seal, of the azimuth thruster, and wherein the impurities removed from the unfiltered oil have a size down to 0.1 micrometre; and using the oil filtration and lubrication system to remove impurities from unfiltered oil and delivering the filtered oil to the azimuth thruster.

* * * * *